US007018184B2

(12) United States Patent
Skinner et al.

(10) Patent No.: US 7,018,184 B2
(45) Date of Patent: Mar. 28, 2006

(54) COMPRESSOR ASSEMBLY HAVING BAFFLE

(75) Inventors: Robin G. Skinner, Tecumseh, MI (US); Richard C. Haney, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/657,652

(22) Filed: Sep. 8, 2003

(65) Prior Publication Data

US 2004/0057849 A1 Mar. 25, 2004

Related U.S. Application Data

(60) Provisional application No. 60/412,768, filed on Sep. 23, 2002.

(51) Int. Cl.
*F01C 1/02* (2006.01)
*F04C 18/00* (2006.01)

(52) U.S. Cl. ..... 418/55.1; 418/55.6; 418/94; 418/97; 418/DIG. 1

(58) Field of Classification Search ..... 418/55.1, 418/94, 97, 89, DIG. 1, 55.6
See application file for complete search history.

(56) References Cited

U.S. PATENT DOCUMENTS

| | | | | |
|---|---|---|---|---|
| 2,661,172 | A | 12/1953 | Needham | |
| 3,039,725 | A | 6/1962 | Kerley, Jr. | |
| RE25,569 | E | 5/1964 | Coron et al. | |
| 3,145,960 | A | 8/1964 | Langdon | |
| 3,749,340 | A | 7/1973 | Williams et al. | |
| 3,785,167 | A | 1/1974 | Sahs | |
| 4,089,613 | A | 5/1978 | Babbitt, Jr. | |
| 4,244,680 | A | 1/1981 | Ishizuka et al. | |
| 4,389,171 | A | 6/1983 | Eber et al. | |
| 4,416,594 | A | 11/1983 | Ichikawa | |
| 4,497,615 | A | 2/1985 | Griffith | |
| 4,518,276 | A | 5/1985 | Mitchell | |
| 4,552,518 | A | 11/1985 | Utter | |
| 4,557,677 | A | 12/1985 | Hasegawa | |
| 4,560,329 | A * | 12/1985 | Hirahara et al. | 418/47 |
| 4,685,188 | A | 8/1987 | Goy | |
| 4,767,293 | A | 8/1988 | Caillat et al. | |
| 4,792,288 | A | 12/1988 | Gromoll et al. | |
| 4,818,198 | A | 4/1989 | Tamura et al. | |
| 4,877,382 | A | 10/1989 | Caillat et al. | |
| 4,886,435 | A * | 12/1989 | Sawai et al. | 418/DIG. 1 |

(Continued)

FOREIGN PATENT DOCUMENTS

FR 2 755 477 A1 11/1997

(Continued)

*Primary Examiner*—Theresa Trieu
(74) *Attorney, Agent, or Firm*—Baker & Daniels

(57) ABSTRACT

A compressor assembly having a housing with a first inlet. A compressor mechanism within the housing has a second inlet leading to a working space wherein gas is compressed. A baffle surface is extends from proximate the first inlet to proximate the second inlet and is impactable by gas entering the housing through the first inlet. The baffle surface directs gas in a flow path from the first inlet toward the second inlet and defines a baffle opening positioned between the first and second inlets. The length of the baffle opening extends substantially transverse to the flow path and is substantially greater than its width. The baffle opening diverts a portion of the gas directed along the flow path through the opening and intercepts fluid, such as lubricating oil, collected on the baffle surface whereby the fluid is separable by passage through the opening from gas entering the second inlet.

31 Claims, 11 Drawing Sheets

U.S. PATENT DOCUMENTS 4,992,033 A 2/1991 Caillat et al.
5,012,896 A 5/1991 Da Costa
5,055,010 A 10/1991 Logan
5,062,779 A 11/1991 Da Costa
5,110,268 A 5/1992 Sakurai et al.
5,114,322 A 5/1992 Caillat et al.
5,137,437 A 8/1992 Machida et al.
5,176,506 A 1/1993 Siebel
5,211,031 A 5/1993 Murayama et al.
RE34,297 E 6/1993 Elson
5,219,281 A 6/1993 Caillat et al.
5,222,885 A 6/1993 Ramshankar et al.
5,224,845 A 7/1993 Mangyo et al.
5,240,391 A 8/1993 Ramshankar et al.
5,247,738 A 9/1993 Yoshii
5,312,234 A 5/1994 Yoshii
5,345,785 A 9/1994 Sekigami et al.
5,345,970 A 9/1994 Leyderman et al.
5,346,375 A 9/1994 Akiyama et al.
5,348,455 A 9/1994 Herrick et al.
5,370,156 A 12/1994 Peracchio et al.
5,391,066 A 2/1995 Sawai et al.
5,427,511 A 6/1995 Caillat et al.
5,474,433 A 12/1995 Chang et al.
5,487,648 A 1/1996 Alfano et al.
5,522,715 A 6/1996 Watanabe et al.
5,531,577 A 7/1996 Hayase et al.
5,533,875 A 7/1996 Crum et al.
5,579,651 A 12/1996 Sugiyama et al.
5,580,233 A 12/1996 Wakana et al.
5,597,293 A 1/1997 Bushnell et al.
5,597,296 A 1/1997 Akazawa et al.
5,634,781 A 6/1997 Yoshida et al.
5,645,408 A 7/1997 Fujio et al.
5,660,539 A 8/1997 Matsunaga et al.
5,683,237 A 11/1997 Hagiwara et al.
5,695,326 A 12/1997 Oka et al.
5,716,202 A 2/1998 Koyama et al.
5,720,601 A 2/1998 Tark et al.
5,745,992 A 5/1998 Caillat et al.
5,752,688 A 5/1998 Campbell et al.
5,769,126 A 6/1998 Cho
5,772,411 A 6/1998 Crum et al.
5,772,416 A 6/1998 Caillat et al.
5,775,894 A 7/1998 Kosco, Jr.
5,810,572 A 9/1998 Yamamoto et al.
5,829,959 A 11/1998 Tsubono et al.
5,863,190 A 1/1999 Yamamoto et al.
5,913,892 A 6/1999 Kwon
5,931,649 A 8/1999 Caillat et al.
5,931,650 A 8/1999 Yasu et al.
5,947,709 A 9/1999 Koyama et al.
5,964,581 A 10/1999 Iizuka et al.
6,000,917 A 12/1999 Smerud et al.
6,011,336 A 1/2000 Mathis et al.
6,027,321 A 2/2000 Shim et al.
6,039,551 A 3/2000 Takeuchi et al.
6,050,794 A 4/2000 Noboru et al.
6,056,523 A 5/2000 Won et al.
6,106,254 A 8/2000 Hirooka et al.
6,132,191 A 10/2000 Hugenroth et al.
6,139,291 A 10/2000 Perevozchikov
6,156,106 A 12/2000 Kamata
6,162,035 A 12/2000 Hayano et al.
6,167,719 B1 1/2001 Yakumaru et al.
6,171,076 B1 1/2001 Yakumaru et al.
6,179,589 B1 1/2001 Bass et al.
6,186,753 B1 2/2001 Hugenroth et al.
6,224,356 B1 5/2001 Dewar et al.
6,227,830 B1 5/2001 Fields et al.
6,247,910 B1 6/2001 Yokoyama
6,261,073 B1 7/2001 Kumazawa
6,264,446 B1 7/2001 Rajendran et al.
6,280,154 B1 8/2001 Clendenin et al.
6,299,423 B1 10/2001 Perevozchikov
6,305,912 B1 10/2001 Svendsen et al.
6,358,019 B1 * 3/2002 Iversen et al. ..... 417/312
6,402,485 B1 6/2002 Hong et al.
2001/0006603 A1 7/2001 Hong et al. ..... 418/55.1
2001/0055536 A1 12/2001 Bernardi et al. ..... 418/55.6

FOREIGN PATENT DOCUMENTS

JP 361-087994 5/1986
JP 61112795 A * 5/1986
JP 402-061382 3/1990
JP 05288171 A 11/1993
JP 06010859 A * 1/1994
JP 407-259764 10/1995
JP 10148191 A 4/1998
JP 2000345978 A * 12/2000
JP 2001020881 A 1/2001
JP 2001271752 A 10/2001
JP 2002021729 A 1/2002
JP 2002098056 A 4/2002

* cited by examiner

COMPRESSOR ASSEMBLY HAVING BAFFLE

CROSS REFERENCE TO RELATED APPLICATIONS

This application claims priority under 35 U.S.C. 119(e) of U.S. provisional patent application Ser. No. 60/412,768 filed on Sep. 23, 2002 entitled COMPRESSOR ASSEMBLY the disclosure of which is hereby incorporated herein by reference.

BACKGROUND OF THE INVENTION

1. Field of the Invention

The present invention relates to compressors and, more particularly, to compressor assemblies having a baffle surface or baffle member for directing the flow of gas within the compressor housing.

2. Description of the Related Art

It is known to provide compressors having hermetically sealed housings with baffle members within the housing for directing the flow of gas entering the housing. For example, it is known to secure such baffle members to the interior surface of the housing over the inlet to the housing. Securing such baffle members to the interior surface of the housing, however, adds to the complexity of manufacturing the housing. The gas entering the compressor housing may also include oil suspended therein and known compressors utilize a variety of different means for controlling the distribution of oil within the compressor housing. It is desirable to provide a compressor having an improved baffle for directing the flow of gas within the compressor and an improved means for controlling the distribution of oil within the compressor housing.

SUMMARY OF THE INVENTION

The present invention provides an improved compressor assembly which includes a baffle for directing a gas entering the housing of the compressor assembly to the inlet leading to the working space of the compressor mechanism. The baffle member or surface may be secured to the crankcase of the compressor assembly and/or may include an opening or discontinuity for separating a fluid, such as oil, from the gas entering the housing.

The present invention comprises, in one form thereof, a compressor assembly for compressing a gas. The compressor assembly includes a housing having a first inlet and a compressor mechanism disposed within the housing. The compressor mechanism defines a working space wherein gas is compressed within the working space and wherein gas enters the working space through a second inlet. A baffle surface is positioned within the housing and extends from proximate the first inlet to proximate the second inlet. The baffle surface is positioned to be impactable by gas entering the housing through the first inlet. The baffle surface directs gas entering the housing in a flow path from the first inlet to the second inlet. The baffle surface also defines a baffle opening. The baffle opening is positioned between the first inlet and the second inlet and has a length and a width with the length being substantially greater than the width. The length extends in a direction substantially transverse to the flow path and the baffle opening is positioned to divert a portion of the gas directed along the flow path through the opening and intercept fluid collected on said baffle surface whereby the fluid is separable, by passage through said baffle opening, from gas entering the second inlet.

In alternative forms, the compressor assembly may include a sheet-like baffle member secured within the housing and having a first major surface defining the baffle surface. The baffle surface may be positioned to define a passageway between an interior surface of the housing and the baffle surface. The compressor housing may include a substantially cylindrical portion with the first inlet disposed in the substantially cylindrical portion and wherein the baffle surface includes a generally arcuate surface. The first inlet may be positioned at a lower vertical position than the second inlet.

Alternatively, the compressor assembly may include sheet-like baffle member secured within the housing wherein the baffle member has a first major surface defining the baffle surface. The baffle opening in such a baffle member may have first and second edges extending the length of the opening wherein the opening has a configuration wherein a plane connecting the first and second edges is positioned at an angle to the first major surface. Such a baffle member may also define a depression adjacent the first edge of the baffle opening with the depression preceding the first edge in the flow direction. The compressor mechanism used with such a compressor assembly may include a fixed scroll member and an orbiting scroll member engaged with the fixed scroll member. In such an assembly the first edge of the baffle opening may be positioned between the second edge of the baffle opening and the housing inlet with the first edge positioned radially inward of the second edge. A crankcase may also be secured within the housing with the crankcase being engageable with the orbiting scroll and the baffle member being secured to the crankcase. The housing for such an assembly may include a generally cylindrical section with the first inlet disposed in the substantially cylindrical portion and with the baffle surface including a generally arcuate surface. The compressor assembly may be configured wherein the first inlet is positioned at a lower vertical position than the second inlet and an oil sump is disposed within the housing below the baffle member. The baffle member may also include at least one flange along an edge of the baffle member wherein the flange is positioned to direct gas along the flow path.

The present invention comprises, in another form thereof, a compressor assembly for compressing a gas. The compressor assembly includes a housing having a first inlet, a motor disposed within the housing and a crankcase disposed within the housing and secured relative to the motor. A compressor mechanism is operably coupled to the motor and defines a working space wherein gas is compressed within the working space. Gas enters the working space through a second inlet. A baffle member is secured to the crankcase and extends from proximate the first inlet to proximate the second inlet. The baffle member is positioned to be impactable by gas entering the housing through the first inlet. The baffle member directs gas entering the housing in a flow path from the first inlet to the second inlet. The baffle member also defines a baffle opening wherein the baffle opening is positioned between the first inlet and the second inlet and has a length and a width with the length being substantially greater than the width. The length extends in a direction substantially transverse to the flow path whereby fluid collected on the baffle member is separable from gas entering the second inlet by passage through the baffle opening. In alternative forms, such a compressor assembly may include a motor having a rotatable shaft coupled to the compressor mechanism wherein the shaft is positioned substantially horizontally.

The present invention comprises, in yet another form thereof, a compressor assembly for compressing a gas. The compressor assembly including a housing having a first inlet, a motor disposed within the housing, a crankcase disposed within the housing and secured relative to the motor, and a compressor mechanism operably coupled to the motor. The compressor mechanism defines a working space wherein gas is compressed within the working space and wherein gas enters the working space through a second inlet. A baffle member is secured to the crankcase and extends from proximate the first inlet to proximate the second inlet. The baffle member is positioned to be impactable by gas entering the housing through the first inlet and directs gas entering the housing in a flow path from the first inlet to the second inlet. The baffle member includes an arcuate section, first and second radially outwardly extending flanges disposed at opposite ends of the baffle member and a third flange extending along an edge of the baffle member between the first and second flanges. The first and second flanges are secured to the crankcase and the third flange cooperates with the arcuate section and an interior surface of the housing to define a passage between the first inlet and the second inlet.

In alternative forms, the baffle member of such an assembly may be positioned to define a passageway between an interior surface of the housing and the baffle member. Such a housing may also include a substantially cylindrical portion wherein the motor and compressor mechanism are substantially disposed within the cylindrical portion of the housing. The motor may also include a rotatable shaft coupled with the compressor mechanism wherein the shaft is positioned substantially horizontally. The baffle member may be a sheet-like member and define a baffle opening positioned between the first inlet and the second inlet wherein the baffle opening has a length and a width, the length being substantially greater than the width and extending in a direction substantially transverse to the flow path.

The present invention comprises, in still another form thereof, a compressor assembly for compressing a gas. The compressor assembly includes a housing having a first inlet and a first scroll member and a second scroll member. The first and second scroll members are engageable and define a working space therebetween wherein gas is compressed within the working space by the relative movement of the first and second scroll members. Gas enters the working space through a second inlet. The compressor assembly also includes a motor disposed within the housing and a crankcase disposed within the housing. The crankcase includes a thrust surface engageable with one of the scroll members, a bearing support rotatably supporting a shaft, and a plurality of support members secured to the motor. A baffle member is secured to the crankcase and extends from proximate the first inlet to proximate the second inlet and is positioned to be impacted by gas entering the housing through the first inlet. The baffle member directs gas entering the housing in a flow path from the first inlet to the second inlet and defines a baffle opening positioned between the first inlet and the second inlet. The baffle opening has a length and a width with the length being substantially greater than the width. The length extends in a direction substantially transverse to the flow path whereby fluid collected on the baffle member is separable, by passage through the baffle opening, from gas entering the second inlet.

The present invention comprises, in another form thereof, a compressor assembly for compressing a gas. The compressor assembly including a housing having a first inlet and a compressor mechanism disposed within the housing. The compressor mechanism defines a working space wherein gas is compressed within the working space and gas enters the working space through a second inlet. A baffle surface is positioned within the housing and extends from proximate the first inlet to proximate the second inlet. The baffle surface is positioned to be impactable by gas entering the housing through the first inlet and the baffle surface directs gas entering the housing in a flow path from the first inlet to the second inlet. The baffle surface defines a discontinuity in the baffle surface. The discontinuity is positioned between the first inlet and the second inlet and defines a fluid passage for separating fluid collected on the baffle surface from gas entering the second inlet. The discontinuity has a length and a width with the length being substantially greater than the width. The length extends in a direction substantially transverse to the flow path. An oil sump is disposed within the housing below the fluid passage and fluid separated from gas entering the second inlet collects in the oil sump.

An advantage of the present invention is that the use of a baffle which is positioned between the inlet to a compressor housing and the inlet to the working space of a compressor mechanism and which includes an opening or discontinuity in the baffle provides for the stripping of oil from the gas, such as a refrigerant, which enters the housing and is directed by the baffle towards the compressor mechanism by allowing the oil to collect on the baffle and diverting the oil from the compressor mechanism by the use of the opening or discontinuity.

Another advantage of the present invention is that it provides a baffle for directing gas flow from the inlet of the compressor housing to the inlet to the working space of the compressor mechanism which may be secured to the crankcase of the motor operably coupled to the compressor mechanism. The securement of the baffle to the crankcase facilitates the efficient manufacture of the compressor by enabling the assembly of a subassembly which includes a motor, crankcase with attached baffle, and compressor mechanism prior to insertion of this subassembly into the housing of the compressor. The fully assembled compressor is thereby provided with a baffle which directs gas from the housing inlet to the inlet of the working space of the compressor mechanism without requiring the attachment of a baffle member to the interior surface of the housing.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
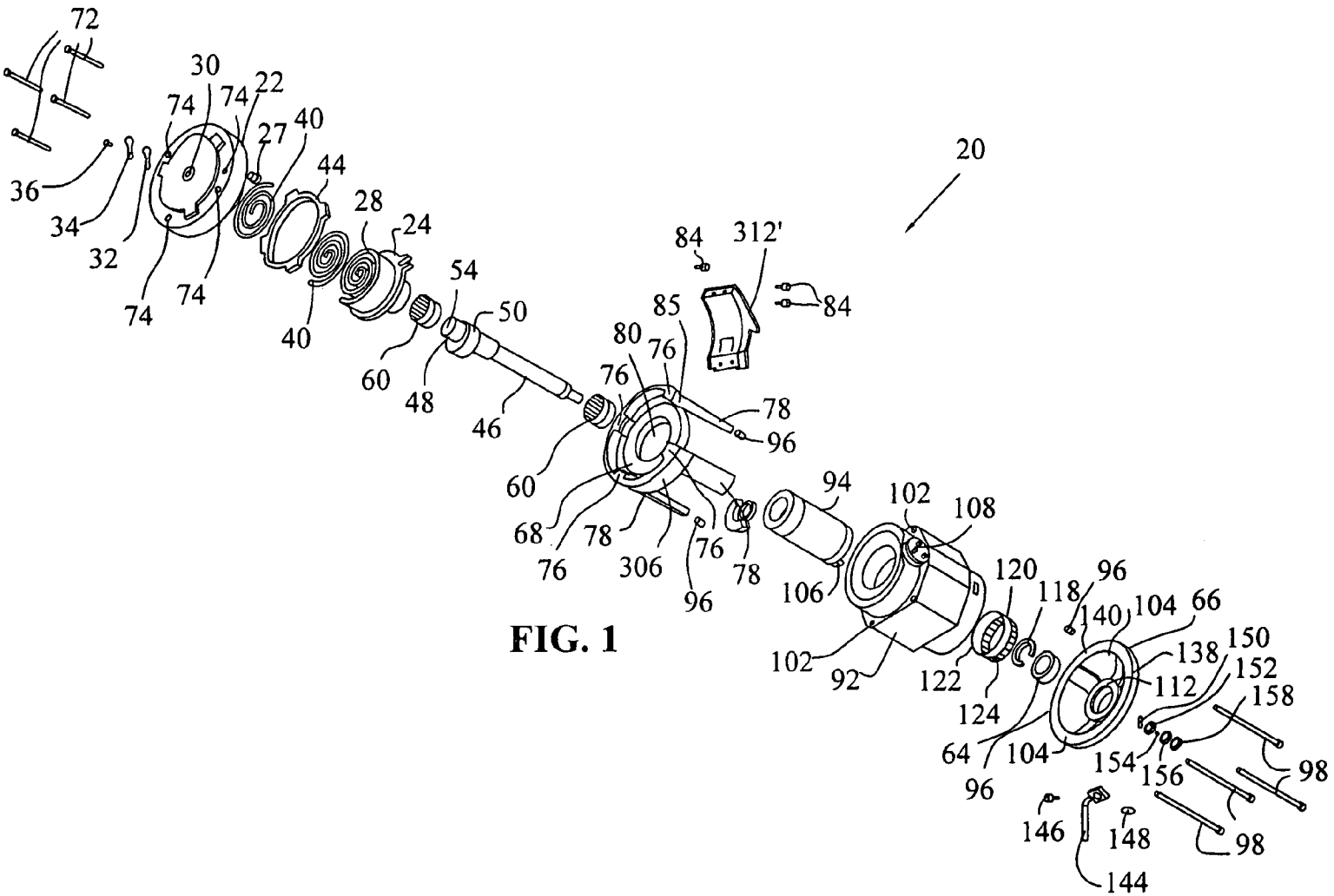
FIG. 1 is an exploded view of a scroll compressor in accordance with the present invention.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

In accordance with the present invention, a scroll compressor 20 is shown in an exploded view in FIG. 1. Scroll compressor 20 includes a fixed or stationary scroll member 22 which is engaged with an orbiting scroll member 24. Fixed and orbiting scroll members 22, 24 each respectively include an involute wrap 26, 28. A refrigerant is compressed between scroll members 22, 24 in pockets which are formed between involute wraps 26, 28 and which migrate radially inwardly as scroll member 24 orbitally moves relative to fixed scroll member 22. The refrigerant enters the space between the scroll members at low pressure through inlet 23 (FIG. 4) located at the radially outer portion of the space formed between scroll members 22, 24 and is discharged at a relatively high pressure through a discharge port 30 located proximate the radial center of fixed scroll member 22. Scroll members 22, 24 each have carbon steel tip seals 40 mounted in recesses located in the distal tips of involute wraps 26, 28, for providing a seal between involute wraps 26, 28 and the base plate of the opposing scroll member.

A one-way valve allows compressed refrigerant to be discharged into a discharge chamber or plenum 38 and prevents compressed refrigerant located in discharge plenum 38 from reentering discharge port 30. The valve includes an exhaust valve leaf 32 which sealingly engages fixed scroll member 22 at discharge port 30 and an exhaust valve retainer 34. Valve leaf 32 is secured between fixed scroll member 22 and valve retainer 34. Valve retainer 34 has a bend at its distal end which allows valve leaf 32 to flex outwardly away from discharge port 30 when gas is compressed between scroll members 22, 24 and thereby permit the passage of high pressure gas into discharge plenum 38. Valve retainer 34 limits the extent to which valve leaf 32 may flex outwardly away from discharge port 30 to prevent damage from excessive flexing of valve leaf 32. A threaded fastener 36 secures valve retainer 34 and valve leaf 32 to fixed scroll member 22. Alternative valve assemblies that may be used with compressor 20 are described by Haller et al. in U.S. Provisional Patent Application Ser. No. 60/412,905 entitled COMPRESSOR HAVING DISCHARGE VALVE filed on Sep. 23, 2002 and which is hereby incorporated herein by reference. Pressure relief valve 27 is positioned between scroll members 22, 24 to allow discharge pressure gas to be directed into the suction pressure inlet in the event of overpressurization.

An Oldham ring 44 is disposed between fixed scroll member 22 and orbiting scroll member 24 to control the relative motion between orbiting scroll member 24 and fixed scroll member 22. Orbiting scroll 24 is mounted on an eccentrically positioned extension 48 on shaft 46 and rotation of shaft 46 imparts a relative orbital movement between orbiting scroll 24 and fixed scroll 22. The use of shafts having eccentrically positioned extensions and Oldham rings to impart a relative orbital motion between scroll members of a compressor is well known to those having ordinary skill in the art.

A counterweight 50 (FIG. 1) includes a collar portion with an opening through which shaft 46 is inserted. Counterweight 50 is not shown in FIGS. 3 and 4. Counterweight 50 also includes a partially cylindrical wall which eccentrically loads shaft 46 to counterbalance the eccentric loading of shaft 46 by orbiting scroll 24. Counterweight 50 is heat shrink fitted onto shaft 46 in the illustrated embodiment and is disposed between crankcase shield 308 and rotor 94 in the assembled compressor assembly. Shaft 46 includes an internal passageway 54 extending the longitudinal length of shaft 46 and secondary passages 56 extending transversely from passageway 54 to the radially outer surface of shaft 46. Passageways 54, 56 communicate lubricating oil between oil sump 58, which is located in the suction pressure chamber of the compressor housing, and bearings rotatably engaging shaft 46.

Two roller bearings 60 are positioned on shaft 46 where shaft 46 respectively engages orbiting scroll 24 and crankcase 306. A ball bearing 64 is positioned near the opposite end of shaft 46 and is mounted within bearing support 66. Shaft 46 may be supported in a manner similar to that described by Haller et al. in U.S. patent application Ser. No. 09/964,241 filed Sep. 26, 2001 entitled SHAFT AXIAL COMPLIANCE MECHANISM and which is hereby incorporated herein by reference.

Crankcase 306 is secured to fixed scroll 22 with threaded fasteners 72 which pass through apertures 74 located in fixed scroll 22 and engage threaded bores 76 in crankcase 306. Crankcase 306 includes a thrust surface 68 which slidably engages orbiting scroll 24 and restricts movement of orbiting scroll 24 away from fixed scroll 22. Crankcase 306 also includes four legs 78 which secure the crankcase to stator 92 as described in greater detail below. Shaft 46 extends through opening 80 in crankcase 306. Crankcase 306 includes a shroud or shield portion 308 which is disposed between legs 78 in the lower portion of the horizontal compressor housing and partially encloses a space within which shaft 46 rotates. Shroud 308 includes an opening or aperture 310 along its lower portion which permits the equalization of pressure between the space partially enclosed by shroud 308 and the remainder of the low pressure chamber or plenum 39 of compressor 20. Low pressure plenum 39 includes that space within compressor housing 88 located between orbiting scroll 24 and end cap 168 and receives the suction pressure refrigerant which is returned to compressor 20 through inlet tube 86.

A suction baffle 312 is secured to crankcase 306 using fasteners. The illustrated fasteners are socket head cap screws 84 but other fasteners such as self-tapping screws and other fastening methods may also be used to secure suction baffle 312. Suction baffle 312 is positioned proximate inlet tube 86. Refrigerant enters compressor housing 88 through inlet tube 86 and suction baffle 312 is positioned in the flow path of entering refrigerant to redirect the refrigerant as described in greater detail below. The outer perimeter of crankcase 306 includes a recess 85 adjacent suction baffle 312 which defines a passage to inlet 23. Crankcase 306 includes a sleeve portion 89 in which roller bearing 60 is mounted for rotatably supporting shaft 46. Sleeve 89 is supported by shroud portion 308 opposite opening 80. A counterweight 50 is located on shaft 46 between sleeve 89 and motor 90.

Figure 5:
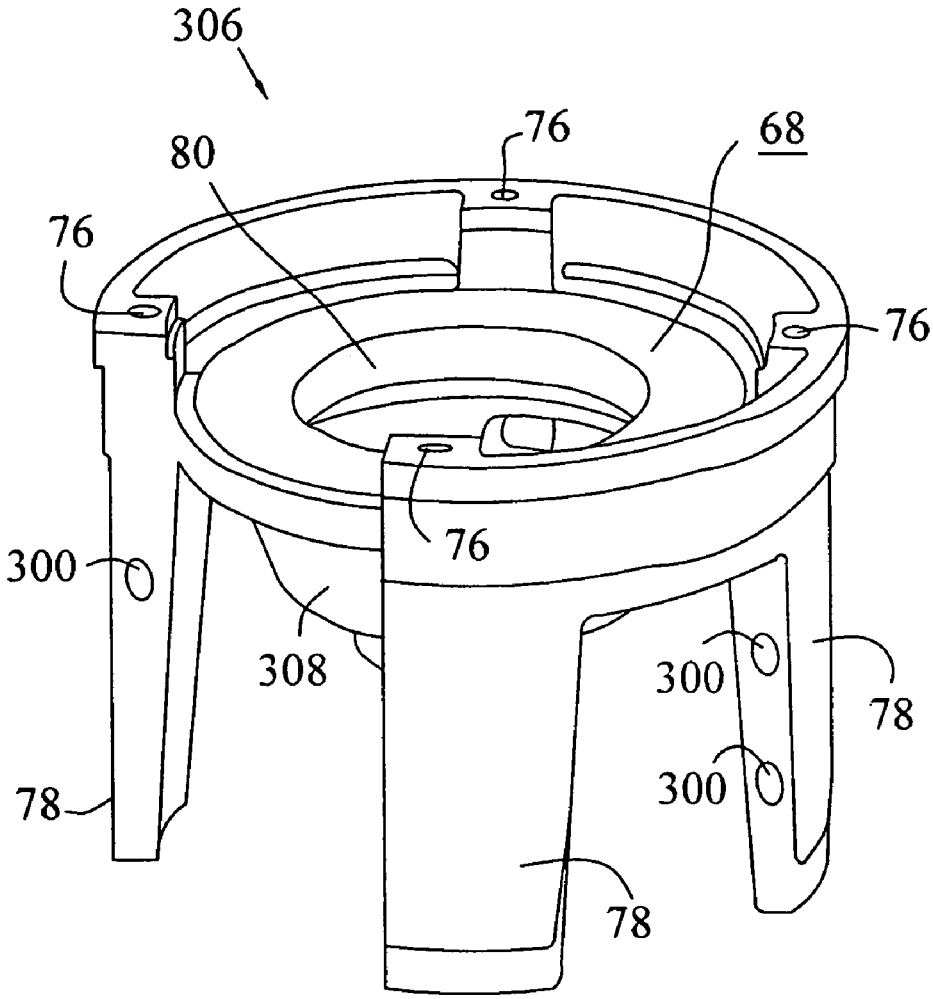
FIG. 5 is a perspective view of a crankcase.
Figure 6:
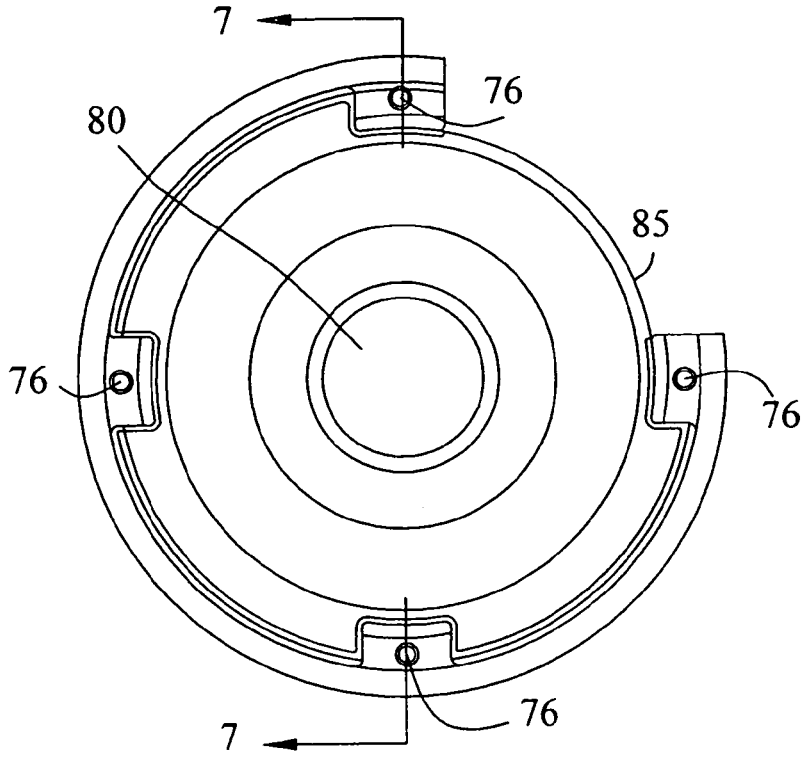
FIG. 6 is an end view of the crankcase.
Figure 7:
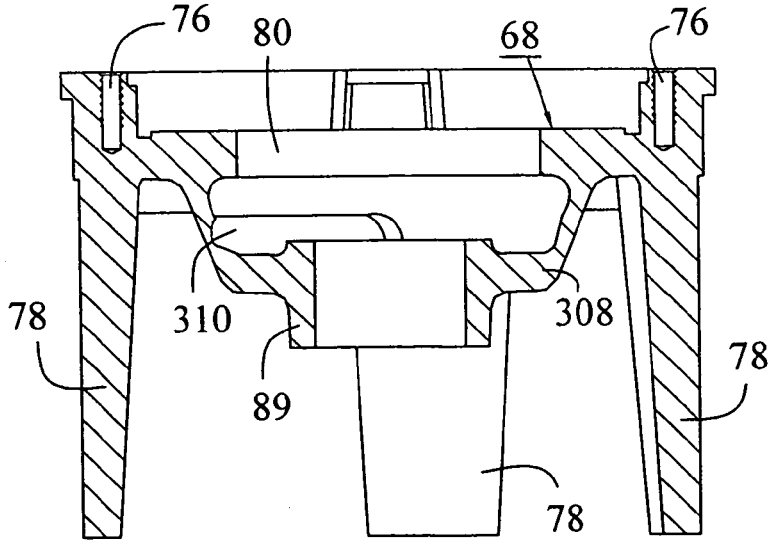
FIG. 7 is a cross sectional view taken along line 7—7 of FIG. 6.
Figure 8:
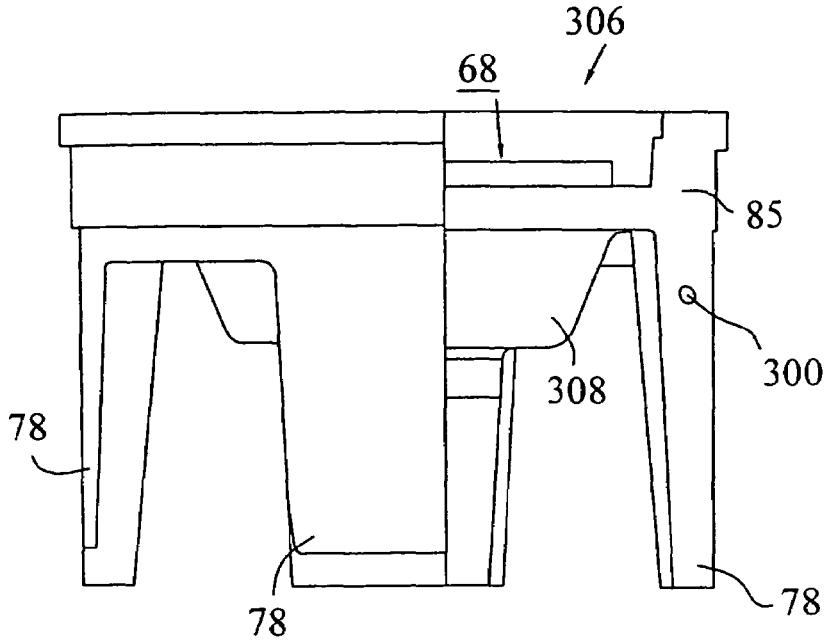
FIG. 8 is a side view of the crankcase.

Crankcase 306 is shown in FIGS. 5–7. As shown in these Figures, crankcase 306 includes a plurality of legs 78. Two legs 78 include threaded bores 300 which receive screws 84 for attaching suction baffle 312. In the illustrated embodiment suction baffle 312 is formed out of sheet metal. Other materials may also be used to form suction baffle 312, for example, suction baffle 312 may be formed out of injection molded plastic.

Shroud 308 encircles the compressor shaft for approximately 270 degrees and includes an aperture 310 which extends for an arc of about 90 degrees about the compressor shaft. When assembled, aperture 310 is positioned below the compressor shaft and defines the lowest portion of the shroud 308. By positioning aperture 310 below the compressor shaft, the oil collecting in the partial enclosure defined by shroud 308 by the lubrication of the shaft is allowed to return to sump 58. Crankcase 306 is manufactured by metal casting and subsequent machining of the metal cast part.

Suction baffle 312 (FIGS. 9–11) or suction baffle 312' (FIGS. 12–16) may be used with crankcase 306. Suction baffle 312 and suction baffle 312' function in the same manner and differ in that suction baffle 312 is configured for use with an inlet tube 86 positioned at location 86*a*, shown in FIG. 2, while suction baffle 312' is configured for use with an inlet tube 86 positioned at location 86*b*, shown in dashed outline in FIG. 2. Common features of suction baffles 312 and 312' which function in a similar manner have been given common reference characters with those features of suction baffle 312' being designated with a prime reference character.

Figure 9:
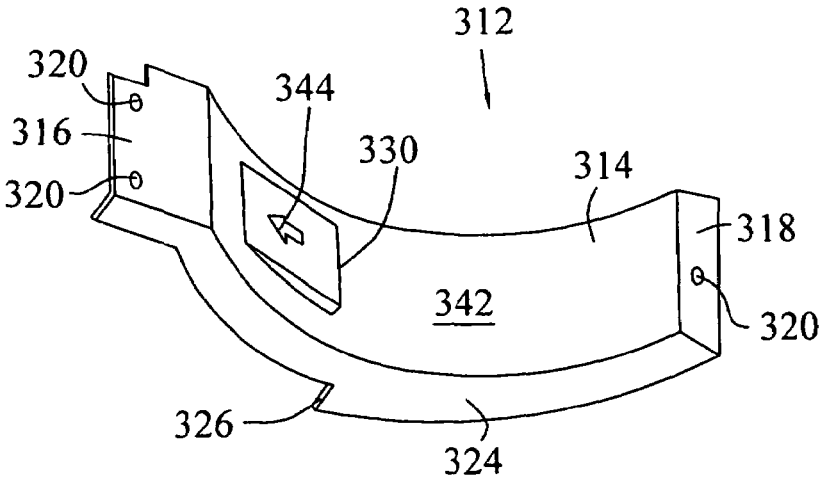
FIG. 9 is perspective view of a suction baffle.
Figure 10:
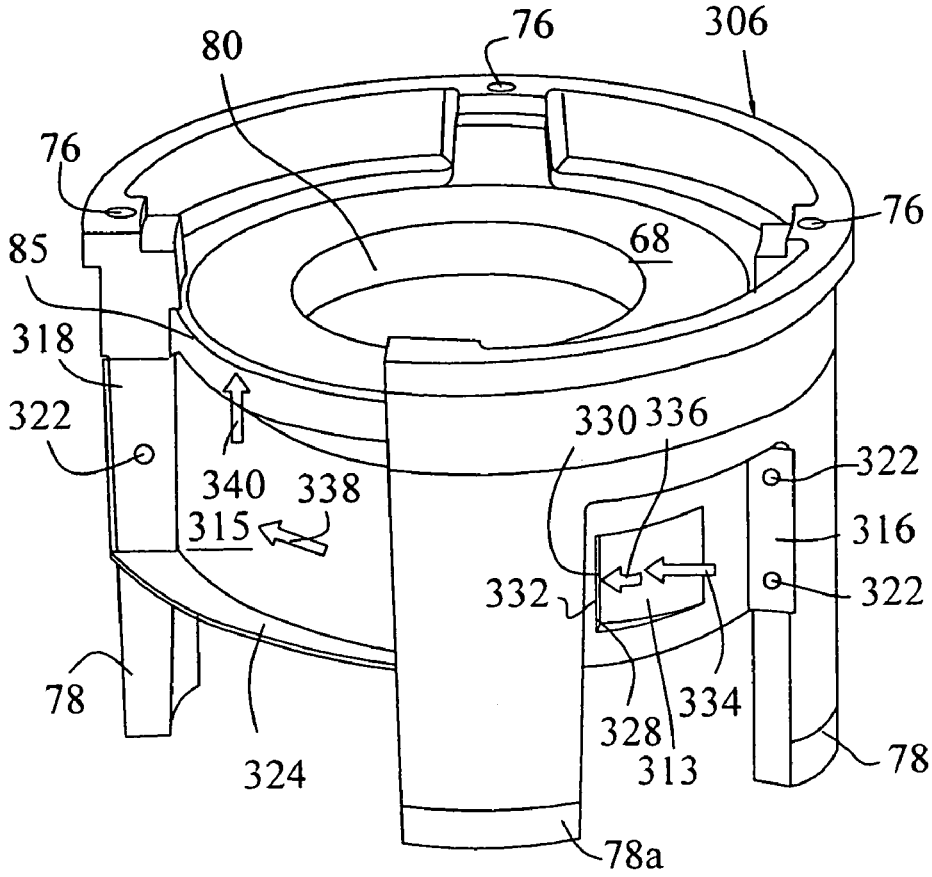
FIG. 10 is a perspective view of a crankcase with attached suction baffle.
Figure 11:
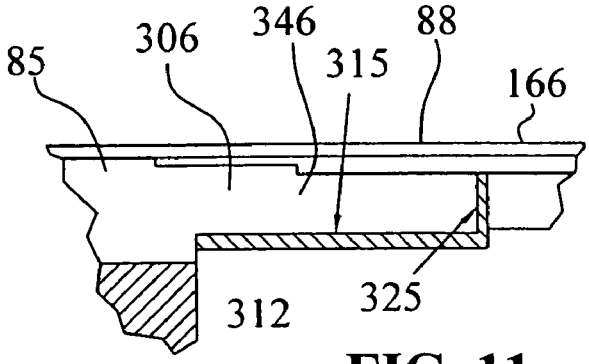
FIG. 11 is partial cross section view of the crankcase and suction baffle of FIG. 10 in a compressor assembly.

Turning first to suction baffle 312 shown in FIGS. 9–11, suction baffle 312 includes a generally arcuate section 314 which has flanges 316 and 318 at its opposite ends. Flanges 316, 318 each include openings 320 through which threaded fasteners 322 may be inserted to secure baffle member 312 to crankcase 306. Suction baffle 312 also includes a lower flange 324 which extends along one edge of arcuate section 314. Lower flange 324 includes a cutout portion 326 which interfits with leg 78*a* (FIG. 10) of crankcase 306. Arcuate section 314 also includes a baffle opening 328 which has a length substantially greater than its width, i.e., it is a generally elongate opening. First and second edges 330 and 332 run the length of opening 328 and define its width therebetween.

Figure 2:
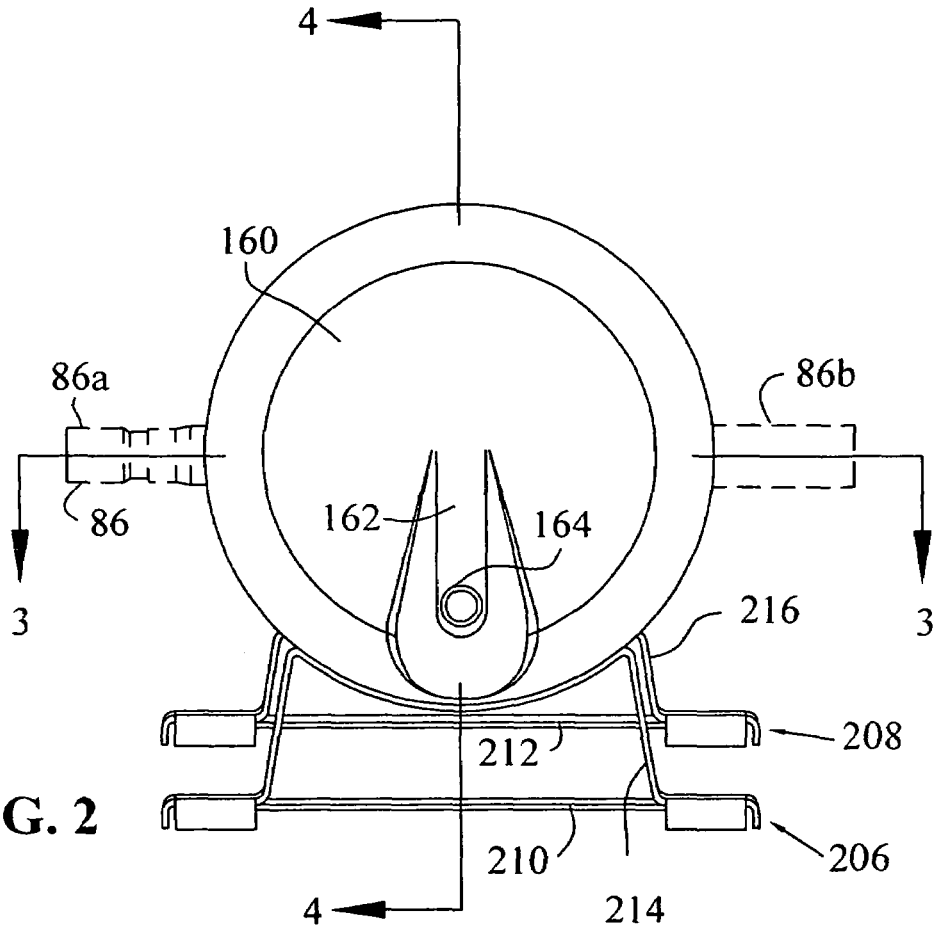
FIG. 2 is an end view of the compressor of FIG. 1.

As shown in FIG. 2, inlet tube 86 is positioned to enter housing 88 at a mid-height level in the illustrated embodiments, however, alternative locations of inlet tube 86 may also be employed with the present invention. Refrigerant entering housing 88 is represented by arrow 334. Arrow 334 together with arrows 336, 338 and 340 represent the flow path of refrigerant from inlet tube 86 to inlet 23 to working space 301 defined between scroll members 22, 24 wherein the refrigerant is compressed. As can be seen in FIG. 10, entering refrigerant, arrow 334, strikes baffle member 312 and is guided by arcuate section 314 and lower flange 324 in the direction shown by arrow 336. The outer surfaces of arcuate section 314 and flange 324 guide the refrigerant and thereby form baffle surfaces 315 and 325. As entering refrigerant strikes baffle surface 315, the oil carried by the refrigerant vapor will tend to collect on baffle surface 315. The refrigerant then flows in the direction of arrow 336 in a generally vertically upward direction and encounters opening 328 which has a length which extends substantially transverse to flow direction 336. The oil on baffle surface 315 will tend to migrate in the direction shown by arrow 336 under the influence of vapor flow. The discontinuity in baffle surface 315 defined by opening 328 functions as an oil stripper, preventing the majority of oil on baffle surface 315 from further migration along surface 315 under the influence of vapor flow. Once oil reaches opening 328 it passes through opening 328 and then migrates downwardly along the rear surface 342 of baffle member 312 in the direction shown by arrow 344 in FIG. 9. Arrow 344 indicates the flow direction of oil under the influence of gravity when baffle member 312 is assembled with compressor 20. Oil separated from the refrigerant by baffle member 312 may return to oil sump 58 under the influence of gravity along rear surface 342 as indicated by arrow 344. Suction baffle 312 also shields the entering refrigerant from oil slung radially outwardly by rotating shaft 46 and rotating counterweight 50.

Baffle member 312 is formed out of a sheet-like material and has a first major surface which defines baffle surface 315. The first and second edges 330, 332 of baffle opening 328 define a plane which is positioned at an angle to baffle surface 315 to facilitate the stripping of oil from refrigerant flowing along baffle surface 315. Suction baffle 312' includes a similar baffle opening 328' which is positioned at an angle to baffle surface 315' to facilitate the stripping of oil from refrigerant flowing along baffle surface 315' and the plane defined by first and second edges 330' and 332' corresponds to edge 329' shown in FIG. 13.

Baffle member 312 also defines a depression 313 in baffle surface 315 which precedes the first edge 330 of opening 328 in the direction of refrigerant flow along baffle surface 315. Although in the illustrated embodiment the oil stripping opening 328 generally projects radially inwardly with respect to baffle surface 315, opening 328 could alternatively positioned such as by projecting radially outwardly with respect to baffle surface 315. The configuration of opening 328 may be modified to alter the quantity of refrigerant diverted through opening 328.

Although some refrigerant will enter opening 328 where it may function to cool motor 90, most refrigerant entering housing 88 will follow flow path arrows 336, 338 and 340 along baffle surface 315 and enter the working space of compressor 20 through recess 85. Baffle surface 325 on flange 324 inhibits the flow of refrigerant towards end cap 168. Baffle surface 315 extends from vertically below inlet 86 to recess 85 and together with the interior surface of cylindrical portion 166 of housing 88, baffle surfaces 315 and 325 define a passageway 346 which extends between inlet 86 to housing 88 and inlet 23 to the working space defined between scroll members 22, 24.

Figure 13:
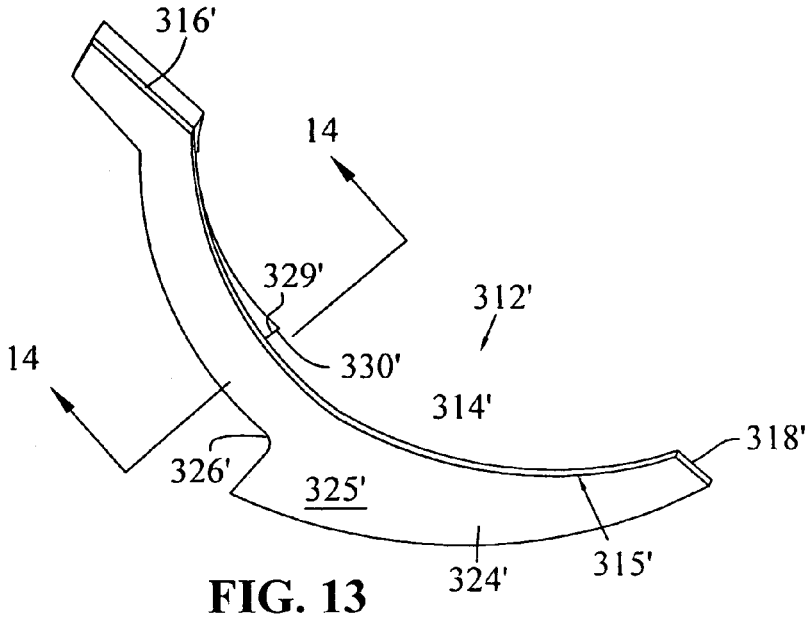
FIG. 13 is an edge view of the suction baffle of FIG. 12.
Figure 14:
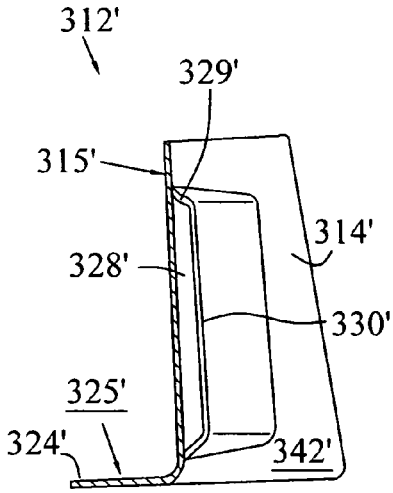
FIG. 14 is a cross sectional view taken along line 14—14 of FIG. 13.
Figure 12:
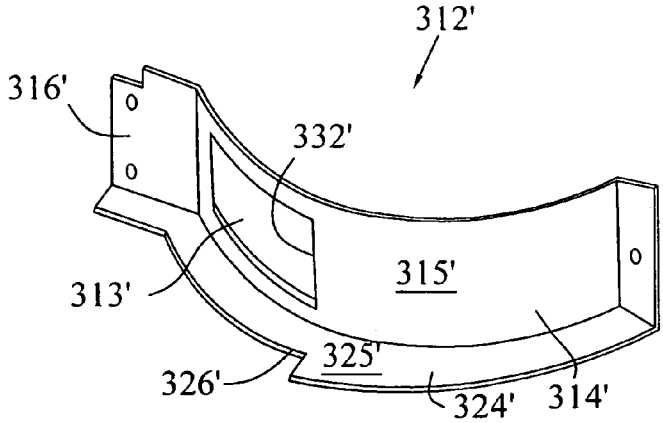
FIG. 12 is a perspective view of another suction baffle.
Figure 15:
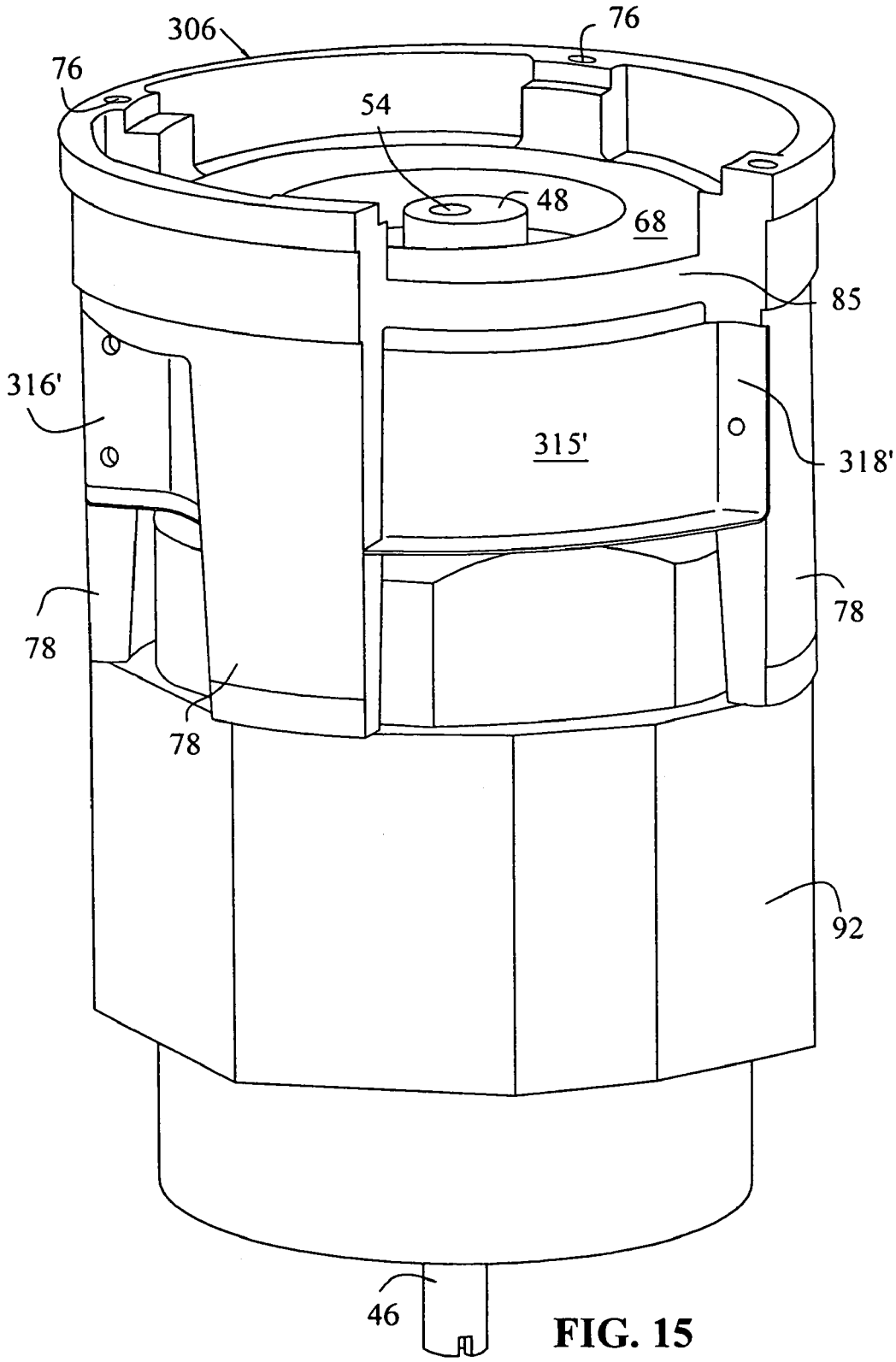
FIG. 15 is a perspective view of the suction baffle of FIG. 12 secured to a crankcase.
Figure 16:
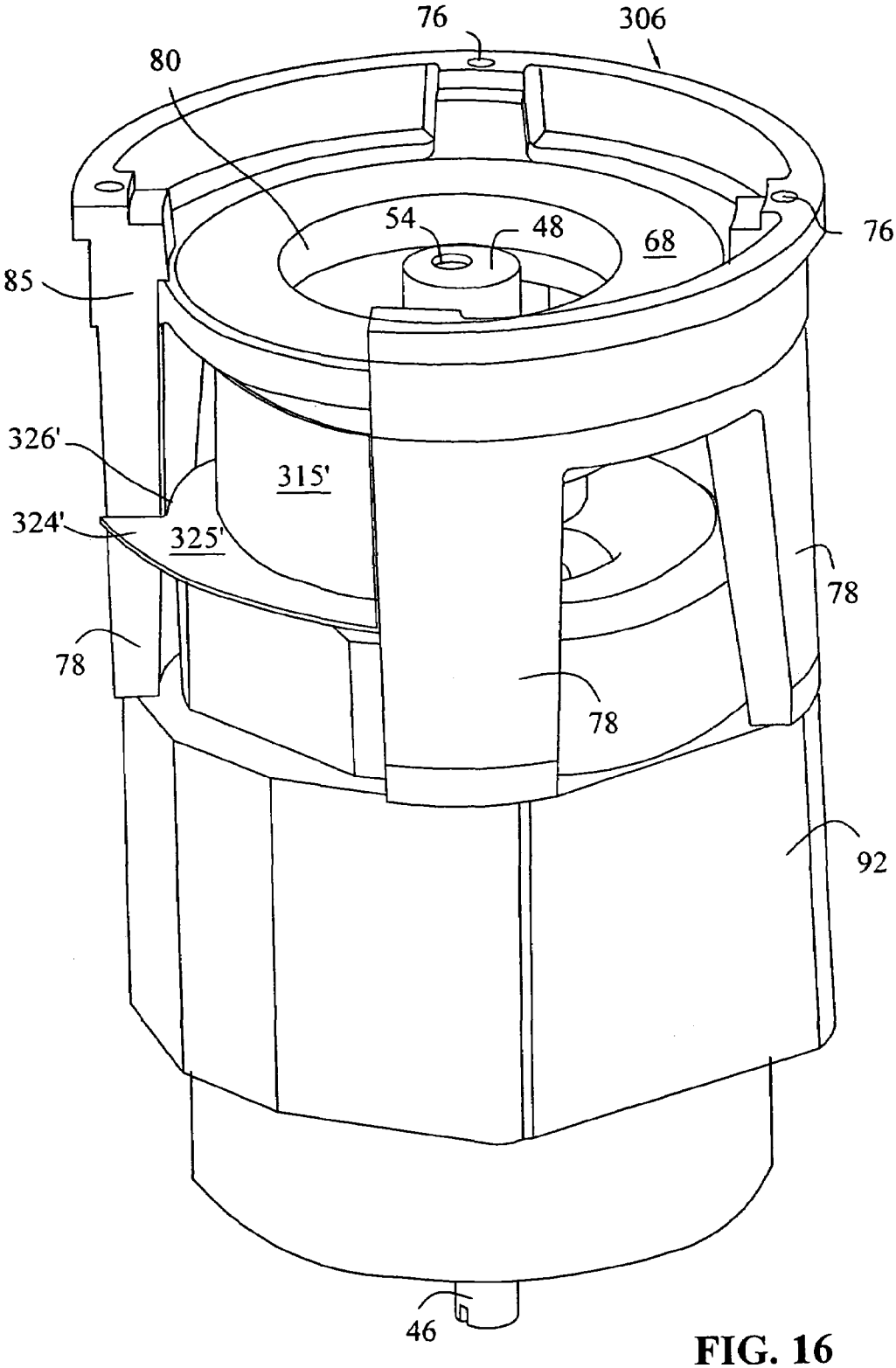
FIG. 16 is another perspective view of the suction baffle of FIG. 12 secured to a crankcase.

FIGS. 12–14 illustrate suction baffle 312' while FIGS. 15 and 16 illustrate suction baffle 312' assembled with crankcase 306. (Fasteners used to secure suction baffle 312' to crankcase 306 are not shown in FIGS. 15 and 16.) Suction baffle 312' directs refrigerant flow and separates oil from the refrigerant vapor in the same manner as described above for suction baffle 312. As discussed above, when baffle member 312' is used with crankcase 306, inlet tube 86 is positioned in the location shown in FIG. 2 as dashed outline 86*b*. It is noted that the perspective view of baffle member 312 shown in FIG. 9 is a view of the generally concave surface 342 of baffle 312 which faces radially inward when baffle 312 is secured to crankcase 306, while the perspective view of baffle member 312' shown in FIG. 12 is a view of the generally convex surface 315' of baffle member 312' which faces radially outward when baffle member 312' is secured to crankcase 306. The illustrated embodiments of suction baffles 312 and 312' may be formed out of bent sheet metal or may be manufactured using other methods such as the injection molding of a plastic material.

A motor 90 is disposed adjacent crankcase 306 and includes a stator 92 and a rotor 94. Bushings 96 are used to properly position stator 92 with respect to crankcase 306 and bearing support 66 when assembling compressor 20. During assembly, crankcase 306, motor 90 and bearing support 66 must have their respective bores through which shaft 46 is inserted precisely aligned. Smooth bore pilot holes 102, 104 which are precisely located relative to these bores are provided in crankcase 306, motor 90 and bearing support 66. Alignment bushings 96 fit tightly within the pilot holes to properly align crankcase 306, motor 90 and bearing support 66. Bolts 98 (FIG. 1) are then used to secure bearing support 66, motor 90 and crankcase 306 together. Pilot holes (not shown) are located on the distal ends of legs 78 in crankcase 306 and bolts 98 are threaded into engagement with threaded portions of the holes in legs 78 when securing crankcase 306, motor 90 and bearing support 66 together. Pilot holes 102 located in stator 92 of motor 90 extend through stator 92 and allow the passage of bolts 98 therethrough. Pilot holes 104 located in bearing support 66 also allow the passage of the shafts of bolts 98 therethrough but prevent the passage of the heads of bolts 98 which bear against bearing support 66 when bolts 98 are engaged with crankcase 306 to thereby secure crankcase 306, motor 90 and bearing support 66 together. In the illustrated embodiment, bushings 96 are hollow sleeves and bolts 98 are inserted through bushings 96. Alternative embodiments, however, could employ pilot holes and bushings to properly align crankcase 306, motor 90 and bearing support 66 with different methods of securing these parts together. For example, the pilot holes could be separate from the openings through which bolts 98 are inserted or alternative methods of securing crankcase 306, motor 90 and bearing support 66 together could be employed with the use of pilot holes and alignment bushings 96. Alignment bushings which may be used with compressor 20 are described by Skinner in U.S. Provisional Patent Application Ser. No. 60/412,868 entitled COMPRESSOR HAVING ALIGNMENT BUSHINGS AND ASSEMBLY METHOD filed on Sep. 27, 2002 and which is hereby incorporated herein by reference.

A terminal pin cluster 108 is located on motor 90 and wiring (not shown) connects cluster 108 with a second terminal pin cluster 110 mounted in end cap 168 and through which electrical power is supplied to motor 90. A terminal guard or fence 111 is welded to end cap 168 and surrounds terminal cluster 110. Shaft 46 extends through the bore of rotor 94 and is rotationally secured thereto by a shrink fit whereby rotation of rotor 94 also rotates shaft 46. Rotor 94 includes a counterweight 106 at its end proximate bearing support 66.

Figure 4:
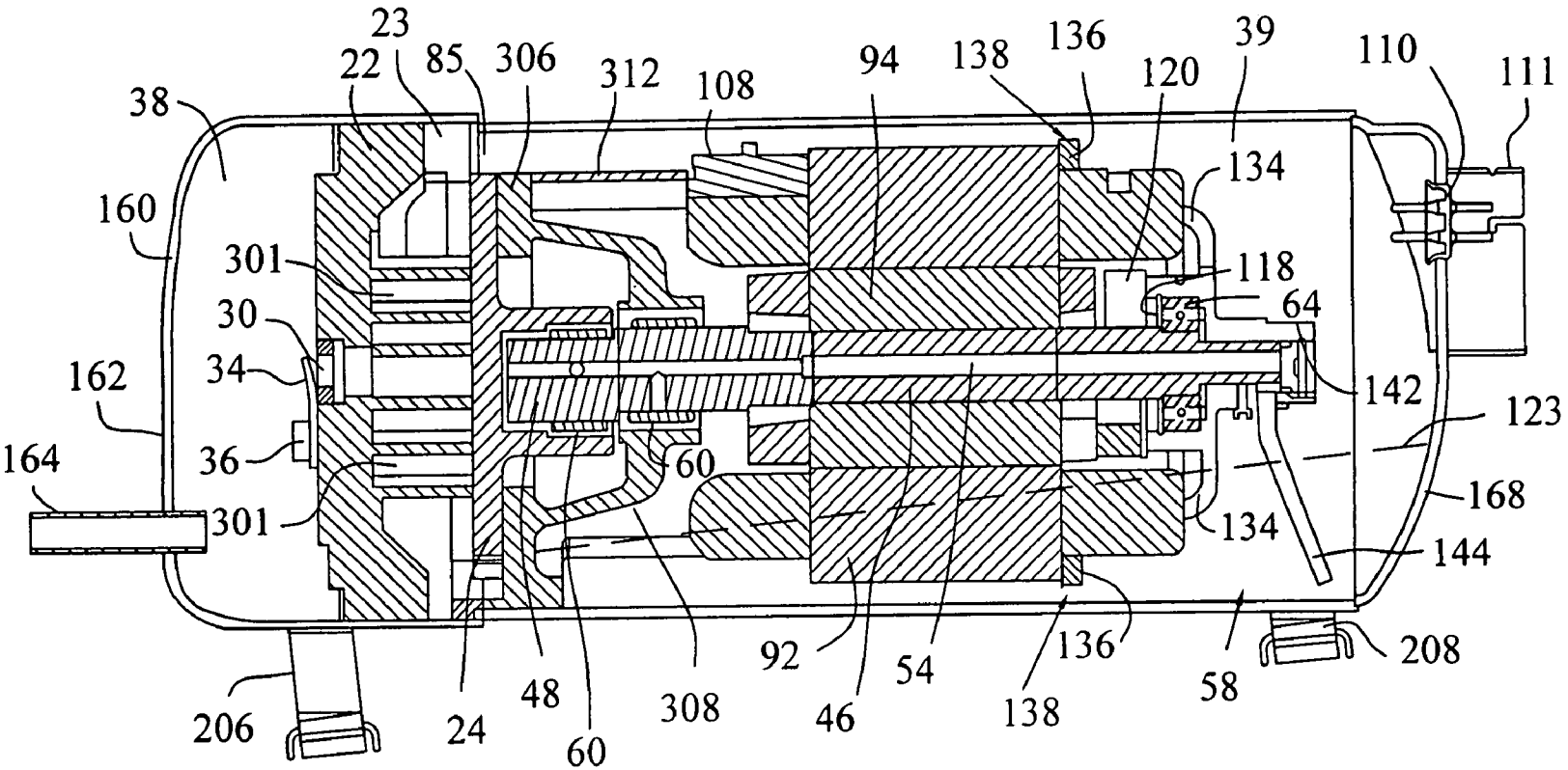
FIG. 4 is a sectional view of the compressor of FIG. 2 taken along line 4—4.

As mentioned above, shaft 46 is rotatably supported by ball bearing 64 which is mounted in bearing support 66. Bearing support 66 includes a central boss 112 which defines a substantially cylindrical opening 114 in which ball bearing 64 is mounted. A retaining ring 118 is fitted within a groove located in the interior of the opening in boss 112 to retain ball bearing 64 within boss 112. An oil shield 120 is secured to boss 112 and has a cylindrical portion 122 which extends toward motor 90 therefrom. Counterweight 106 is disposed within the space circumscribed by cylindrical portion 122 and is thereby shielded from the oil located in oil sump 58, although it is expected that the oil level 123 will be below oil shield 120 under most circumstances, as shown in FIG. 4. Oil shield 120 is positioned so that it inhibits the impacting of counterweight 106 on oil migrating to oil sump 58 and also inhibits the agitation of oil within oil sump 58 which might be caused by the movement of refrigerant gas created by the rotation of eccentrically positioned counterweight 106. A second substantially cylindrical portion 124 of oil shield 120 has a smaller diameter than the first cylindrical portion 122 and has a plurality of longitudinally extending tabs with radially inwardly bent distal portions. Boss 112 includes a circular groove and oil shield 120 is secured to boss 112 by engaging the radially inwardly bent distal portions with the circular groove. An oil shield which may be used compressor 20 is described by Skinner in U.S. Provisional Patent Application Ser. No. 60/412,838 entitled COMPRESSOR HAVING COUNTERWEIGHT SHIELD filed on Sep. 23, 2002 and which is hereby incorporated herein by reference.

Support arms 134 extend between boss 112 and outer ring 136 of bearing support 66. The outer perimeter of ring 136 is press fit into engagement with housing 88 to secure bearing support 66 therein. The interior perimeter of outer ring 136 faces the windings of stator 92 when bearing support 66 is engaged with motor 90. Flats 138 are located on the outer perimeter of ring 136 and the upper flat 138 facilitates the equalization of pressure within suction plenum by allowing refrigerant to pass between outer ring 136 and housing 88. Flat 138 located along the bottom of ring 136 allows oil in oil sump 58 to pass between ring 136 and housing 88. A notch 140 located on the interior perimeter of outer ring 136 may be used to locate bearing support 66 during machining of bearing support 66 and also facilitates the equalization of pressure within suction plenum 39 by allowing refrigerant to pass between stator 92 and ring 136. The outer perimeter of stator 92 also includes flats to provide passages between stator 92 and housing 88 through which lubricating oil and refrigerant may be communicated.

Support arms 134 are positioned such that the two lowermost arms 134 form an angle of approximately 120 degrees to limit the extent to which the two lowermost arms 134 extend into the oil in sump 58 and thereby limit the displacement of oil within oil sump 58 by such arms 134. A sleeve 142 projects rearwardly from bearing support 66 and provides for uptake of lubricating oil from oil sump 58. An oil pick up tube 144 is secured to sleeve 142 with a threaded fastener 146. An 0-ring 148 provides a seal between oil pick up tube 144 and sleeve 142. As shown in FIG. 1, secured within a bore in sleeve and positioned near the end of shaft 46 are vane 150, reversing port plate 152, pin 154, washer and wave spring 156, and retaining ring 158 which facilitate the communication of lubricating oil through sleeve 112. Although appearing as one part in FIG. 1, washer and wave spring 156 are two separate parts wherein the washer is a flat circular part which does not include a central opening while the wave spring is formed from a sheet material and has a circular outer perimeter and central opening and circumferentially extending undulations. Such washers and wave springs are known in the art. A bearing support which may be used with compressor 20 is described by Haller in U.S. Provisional Patent Application Ser. No. 60/412,890 entitled COMPRESSOR HAVING BEARING SUPPORT filed on Sep. 23, 2002 and which is hereby incorporated herein by reference. The bearing support may also include one or more circumferentially spaced recesses in the surface of the outer ring which bears against the stator whereby any bulges in the laminations of the stator caused by the securing of the bearing support against the stator may project into the recesses. The use of such recesses is described by Skinner et al. in U.S. patent application Ser. No. 10/617,475 entitled BEARING SUPPORT AND STATOR ASSEMBLY FOR COMPRESSOR which is hereby incorporated herein by reference.

Figure 3:
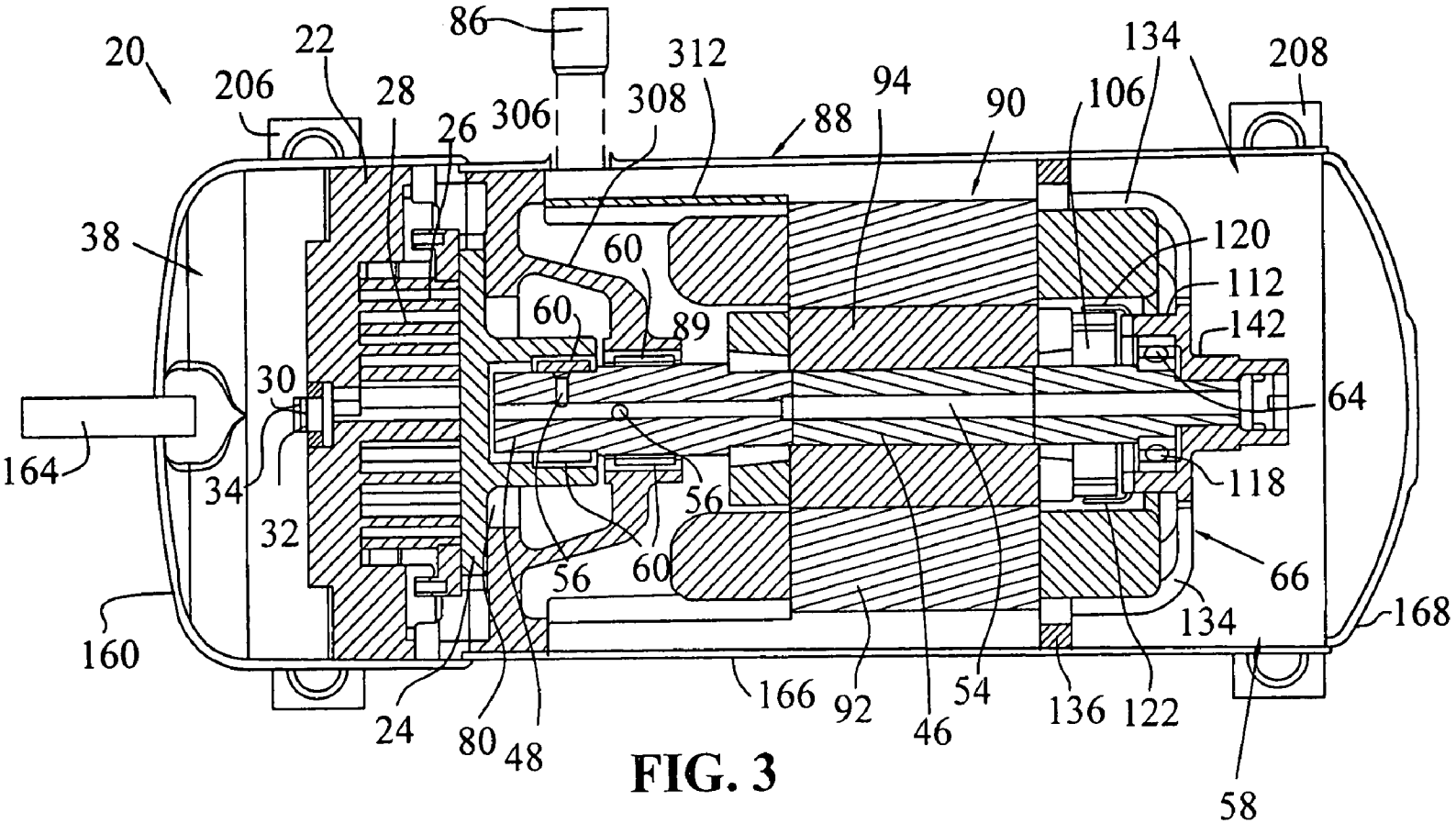
FIG. 3 is a sectional view of the compressor of FIG. 2 taken along line 3—3.

As can be seen in FIGS. 3 and 4, compressor housing 88 includes a discharge end cap 160 having a relatively flat portion 162. Housing 88 also includes a cylindrical shell 166 and rear end cap 168. End caps 160, 168 are welded to cylindrical shell 166 to provide an hermetically sealed enclosure. A discharge tube 164 extends through an opening in flat portion 162. The securement of discharge tube 164 to end cap 160 by welding or brazing is facilitated by the use of flat portion 162 immediately surrounding the opening through which discharge tube 164 is positioned.

After the compressor and motor subassembly is assembled and shrink-fitted into cylindrical housing shell 166, fixed scroll member 22 is positioned within discharge end cap 160 and tightly engages the interior surface of end cap 160. Discharge plenum 38 is formed between discharge end cap 160 and fixed scroll member 22. As compressed refrigerant is discharged through discharge port 30 it enters discharge plenum 38 and is subsequently discharged from compressor 20 through discharge tube 164. Compressed refrigerant carries oil with it as it enters discharge plenum 38. Some of this oil will separate from the refrigerant and accumulate in the bottom portion of discharge plenum 38. Discharge tube 164 is located near the bottom portion of discharge plenum 38 so that the vapor flow discharged through tube 164 will carry with it oil which has settled to the bottom portion of discharge plenum 38 and thereby limit the quantity of oil which can accumulate in discharge plenum 38. Although the illustrated embodiment utilizes a short, straight length of tubing to provide discharge tube 164, alternative embodiments of the discharge outlet may also be used. A discharge plenum configuration which may be used with compressor 20 is described by Skinner in U.S. Provisional Patent Application Ser. No. 60/412,871 entitled COMPRESSOR DISCHARGE ASSEMBLY filed on Sep. 23, 2002 and which is hereby incorporated herein by reference.

Mounting brackets 206 and 208 are welded to housing 88 and support compressor 20 in a generally horizontal orientation. As can be seen in FIG. 4, however, mounting brackets 206, 208 have legs which differ in length such that the axis of shaft 46 defined by passage 54 while substantially horizontal will be positioned at an incline. The configuration of brackets 206, 208 are such that the portion of low pressure plenum 39 positioned below bearing support 66 and which defines oil sump 58 will be the lowermost portion of compressor 20. Bottom brace members 210, 212 may be secured to support members 214, 216 (FIG. 2) by a swaging operation. The mounting brackets used with compressor 20 may be those described by Skinner in U.S. Provisional Patent Application Ser. No. 60/412,884 entitled COMPRESSOR MOUNTING BRACKET AND METHOD OF MAKING filed on Sep. 23, 2002 and which is hereby incorporated herein by reference. Alternative mounting brackets may also be employed. For example, mounting brackets formed by support members similar to members 214 and 216 but which have been given greater rigidity by bending their outer edges downward along the full length of the support members may be used without a cross brace to support compressor 20.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly for compressing a gas, said compressor assembly comprising:

a housing having a first inlet;

a compressor mechanism disposed within said housing and defining a working space wherein gas is compressed within said working space, gas entering said working space through a second inlet; and a baffle surface secured to a portion of said compressor mechanism and spaced from said housing, said baffle surface extending from proximate said first inlet to proximate said second inlet, said baffle surface positioned to be impactable by gas entering said housing through said first inlet, said baffle surface directing gas entering said housing in a flow path from said first inlet to said second inlet, said baffle surface defining a baffle opening, said baffle opening positioned between said first inlet and said second inlet, said baffle opening having a length and a width, said length being substantially greater than said width, said length extending in a direction substantially transverse to said flow path, said baffle opening positioned to divert a portion of said gas directed along said flow path through said opening and intercept fluid collected on said baffle surface whereby the fluid is separable, by passage through said baffle opening, from gas entering said second inlet.

2. The compressor assembly of claim 1 further comprising a sheet-like baffle member secured to a portion of said compressor mechanism, said baffle member having a first major surface defining said baffle surface.

3. The compressor assembly of claim 1 wherein said baffle surface is positioned to define a passageway between an interior surface of said housing and said baffle surface.

4. The compressor assembly of claim 3 wherein said housing includes a substantially cylindrical portion, said first inlet disposed in said substantially cylindrical portion, and said baffle surface includes a generally arcuate surface.

5. The compressor assembly of claim 1 wherein said first inlet is positioned at a lower vertical position than said second inlet.

6. A compressor assembly for compressing a gas, said compressor assembly comprising:

a housing having a first inlet;

a compressor mechanism disposed within said housing and defining a working space wherein gas is compressed within said working space, gas entering said working space through a second inlet; and a baffle surface extending from proximate said first inlet to proximate said second inlet, said baffle surface positioned to be impactable by gas entering said housing through said first inlet, said baffle surface directing gas entering said housing in a flow path from said first inlet to said second inlet, said baffle surface defining a baffle opening, said baffle opening positioned between said first inlet and said second inlet, said baffle opening having a length and a width, said length being substantially greater than said width, said length extending in a direction substantially transverse to said flow path, said baffle opening positioned to divert a portion of said gas directed along said flow path through said opening and intercept fluid collected on said baffle surface whereby the fluid is separable, by passage through said baffle opening, from gas entering said second inlet;

wherein said baffle surface is a sheet-like baffle member secured within said housing, said baffle member having a first major surface defining said baffle surface, said baffle opening having first and second edges extending said length of said opening, said opening having a configuration wherein a plane connecting said first and second edges is positioned at an angle to said first major surface.

7. The compressor assembly of claim 6 wherein said baffle member defines a depression adjacent said first edge, said depression preceding said first edge in said flow direction.

8. The compressor assembly of claim 6 wherein said compressor mechanism comprises a fixed scroll member and an orbiting scroll member engaged with said fixed scroll member, and a crankcase secured within said housing, said crankcase engageable with said orbiting scroll, said baffle member secured to said crankcase.

9. The compressor assembly of claim 8 wherein said housing includes a generally cylindrical section, said first inlet disposed in said substantially cylindrical portion, and said baffle surface comprising a generally arcuate surface.

10. The compressor assembly of claim 9 wherein said first edge is positioned between said second edge and said housing inlet, said first edge positioned radially inward of said second edge.

11. The compressor assembly of claim 6 wherein said first inlet is positioned at a lower vertical position than said second inlet and an oil sump is disposed within said housing below said baffle member.

12. The compressor assembly of claim 6 wherein said baffle member defines at least one flange along an edge of said baffle member, said flange positioned to direct gas along said flow path.

13. A compressor assembly for compressing a gas, said compressor assembly comprising:

a housing having a first inlet;

a motor disposed within said housing;

a crankcase disposed within said housing and secured relative to said motor;

a compressor mechanism operably coupled to said motor and defining a working space wherein gas is compressed within said working space, gas entering said working space through a second inlet; and a baffle member secured to said crankcase and spaced from said housing, said baffle member extending from proximate said first inlet to proximate said second inlet, said baffle member positioned to be impactable by gas entering said housing through said first inlet, said baffle member directing gas entering said housing in a flow path from said first inlet to said second inlet, said baffle member defining a baffle opening, said baffle opening positioned between said first inlet and said second inlet, said baffle opening having a length and a width, said length being substantially greater than said width, said length extending in a direction substantially transverse to said flow path whereby fluid collected on said baffle member is separable from gas entering said second inlet by passage through said baffle opening.

14. The compressor assembly of claim 13 wherein said baffle member is positioned to define a passageway between an interior surface of said housing and said baffle member.

15. The compressor assembly of claim 14 wherein said housing includes a substantially cylindrical portion, said first inlet disposed in said substantially cylindrical portion, and said baffle member includes a generally arcuate section.

16. The compressor assembly of claim 13 wherein said motor includes a rotatable shaft coupled to said compressor mechanism, said shaft positioned substantially horizontally.

17. A compressor assembly for compressing a gas, said compressor assembly comprising:

a housing having a first inlet;

a motor disposed within said housing;

a crankcase disposed within said housing and secured relative to said motor;

a compressor mechanism operably coupled to said motor and defining a working space wherein gas is compressed within said working space, gas entering said working space through a second inlet; and a baffle member secured to said crankcase and extending from proximate said first inlet to proximate said second inlet, said baffle member positioned to be impactable by gas entering said housing through said first inlet, said baffle member directing gas entering said housing in a flow path from said first inlet to said second inlet, said baffle member defining a baffle opening, said baffle opening positioned between said first inlet and said second inlet, said baffle opening having a length and a width, said length being substantially greater than said width, said length extending in a direction substantially transverse to said flow path whereby fluid collected on said baffle member is separable from gas entering said second inlet by passage through said baffle opening;

wherein said baffle member is a sheet-like member, said baffle opening having first and second edges extending said length of said opening, said opening having a configuration wherein a plane connecting said first and second edges is positioned at an angle to said baffle member.

18. A compressor assembly for compressing a gas, said compressor assembly comprising:

a housing having a first inlet;

a motor disposed within said housing;

a crankcase disposed within said housing and secured relative to said motor;

a compressor mechanism operably coupled to said motor and defining a working space wherein gas is compressed within said working space, gas entering said working space through a second inlet; and a baffle member secured to said crankcase and extending from proximate said first inlet to proximate said second inlet, said baffle member positioned to be impactable by gas entering said housing through said first inlet, said baffle member directing gas entering said housing in a flow path from said first inlet to said second inlet, said baffle member including an arcuate section, first and second radially outwardly extending flanges disposed at opposite ends of said baffle member, and a third flange extending along an edge of said member between said first and second flanges, said first and second flanges being secured to said crankcase, said third flange cooperating with said arcuate section and an interior surface of said housing to define a passage between said first inlet and said second inlet.

19. The compressor assembly of claim 18 wherein said baffle member is positioned to define a passageway between an interior surface of said housing and said baffle member.

20. The compressor assembly of claim 19 wherein said housing includes a substantially cylindrical portion, said motor and compressor mechanism being substantially disposed within said cylindrical portion of said housing.

21. The compressor assembly of claim 18 wherein said motor includes a rotatable shaft coupled with said compressor mechanism, said shaft positioned substantially horizontally.

22. The compressor assembly of claim 18 wherein said baffle member comprises a sheet-like member, said baffle member defining a baffle opening positioned between said first inlet and said second inlet, said baffle opening having a length and a width, said length being substantially greater than said width, said length extending in a direction substantially transverse to said flow path.

23. A compressor assembly for compressing a gas, said compressor assembly comprising:

a housing having a first inlet;

a first scroll member and a second scroll member, said first and second scroll members being engageable and defining a working space therebetween wherein gas is compressed within said working space by the relative movement of the first and second scroll members, gas entering said working space through a second inlet;

a motor disposed within said housing;

a crankcase disposed within said housing, said crankcase including a thrust surface engageable with one of said first and second scroll members, a bearing support rotatably supporting a shaft, and a plurality of support members secured to said motor; and a baffle member secured to said crankcase and spaced from said housing, said baffle member extending from proximate said first inlet to proximate said second inlet, said baffle member positioned to be impacted by gas entering said housing through said first inlet, said baffle member directing gas entering said housing in a flow path from said first inlet to said second inlet, said baffle member defining a baffle opening positioned between said first inlet and said second inlet, said baffle opening having a length and a width, said length being substantially greater than said width, said length extending in a direction substantially transverse to said flow path whereby fluid collected on said baffle member is separable, by passage through said baffle opening, from gas entering said second inlet.

24. The compressor assembly of claim 23 wherein said baffle member is positioned to define a passageway between an interior surface of said housing and said baffle member.

25. The compressor assembly of claim 24 wherein said housing includes a substantially cylindrical portion, said first inlet disposed in said substantially cylindrical portion, and said baffle member includes a generally arcuate section.

26. The compressor assembly of claim 23 wherein said motor includes a rotatable shaft coupled to said compressor mechanism, said shaft positioned substantially horizontally.

27. A compressor assembly for compressing a gas, said compressor assembly comprising:

a housing having a first inlet;

a first scroll member and a second scroll member, said first and second scroll members being engageable and defining a working space therebetween wherein gas is compressed within said working space by the relative movement of the first and second scroll members, gas entering said working space through a second inlet;

a motor disposed within said housing;

a crankcase disposed within said housing, said crankcase including a thrust surface engageable with one of said first and second scroll members, a bearing support rotatably supporting a shaft, and a plurality of support members secured to said motor; and a baffle member secured to said crankcase and extending from proximate said first inlet to proximate said second inlet, said baffle member positioned to be impacted by gas entering said housing through said first inlet, said baffle member directing gas entering said housing in a flow path from said first inlet to said second inlet, said baffle member defining a baffle opening positioned between said first inlet and said second inlet, said baffle opening having a length and a width, said length being substantially greater than said width, said length extending in a direction substantially transverse to said flow path whereby fluid collected on said baffle member is separable, by passage through said baffle opening, from gas entering said second inlet;

wherein said baffle member is a sheet-like member, said baffle opening having first and second edges extending said length of said opening, said opening having a configuration wherein a plane connecting said first and second edges is positioned at an angle to said baffle member.

28. A compressor assembly for compressing a gas, said compressor assembly comprising:

a housing having a first inlet;

a compressor mechanism disposed within said housing and defining a working space wherein gas is compressed within said working space, gas entering said working space through a second inlet;

a baffle surface secured to a portion of said compressor mechanism and spaced from said housing, said baffle surface extending from proximate said first inlet to proximate said second inlet, said baffle surface positioned to be impactable by gas entering said housing through said first inlet, said baffle surface directing gas entering said housing in a flow path from said first inlet to said second inlet, said baffle surface defining a discontinuity in said baffle surface, said discontinuity positioned between said first inlet and said second inlet and defining a fluid passage for separating fluid collected on said baffle surface from gas entering said second inlet, said discontinuity having a length and a width, said length being substantially greater than said width, said length extending in a direction substantially transverse to said flow path; and an oil sump disposed within said housing below said fluid passage wherein fluid separated from gas entering said second inlet collects in said oil sump.

29. The compressor of claim 28 further comprising a motor disposed within said housing and a crankcase disposed within said housing and secured relative to said motor, said motor operably coupled to said compressor mechanism and a sheet-like baffle member having a first major planar surface defining said baffle surface, said baffle member secured to said crankcase.

30. The compressor assembly of claim 29 wherein baffle surface is positioned to define a passageway between an interior surface of said housing and said baffle surface.

31. The compressor assembly of claim 29 wherein said motor includes a rotatable shaft coupled to said compressor mechanism, said shaft positioned substantially horizontally.

* * * * *